US005125479A

United States Patent [19]

Nemes et al.

[11] Patent Number: 5,125,479

[45] Date of Patent: Jun. 30, 1992

[54] KNEE SUPPORT APPARATUS

[76] Inventors: Anne Nemes; Miklos Nemes, both of 2216 Richter St., Palm Harbor, Fla. 34683

[21] Appl. No.: 751,138

[22] Filed: Aug. 28, 1991

[51] Int. Cl.[5] ..... A43B 3/00

[52] U.S. Cl. ..... 182/230; 2/24; 36/113

[58] Field of Search ..... 182/230; 2/24; 36/113, 36/116

[56] References Cited

U.S. PATENT DOCUMENTS

| | | | |
|---|---|---|---|
| 2,448,427 | 8/1948 | Gordon | 182/230 |
| 2,627,301 | 2/1953 | Emmett | 182/230 |
| 3,112,812 | 12/1963 | Ramon | 182/230 |
| 4,043,424 | 8/1977 | Crain | 182/230 |
| 4,346,848 | 8/1982 | Hammond | 182/230 |
| 4,747,470 | 5/1988 | Fernandez | 182/230 |
| 4,789,046 | 12/1988 | McDowall | 182/230 |

*Primary Examiner*—Reinaldo P. Machado
*Attorney, Agent, or Firm*—Leon Gilden

[57] ABSTRACT

A knee support apparatus for use as a flotation raft for utilizing a flotation raft with each foot for permitting ease of support of an individual upon a surface, such as concrete to be finished. Each raft includes a knee engaging loop, and a rearwardly oriented foot receiving socket. A modification of the invention includes padding for enhancing comfort of the individual upon an uncured concrete surface.

4 Claims, 4 Drawing Sheets

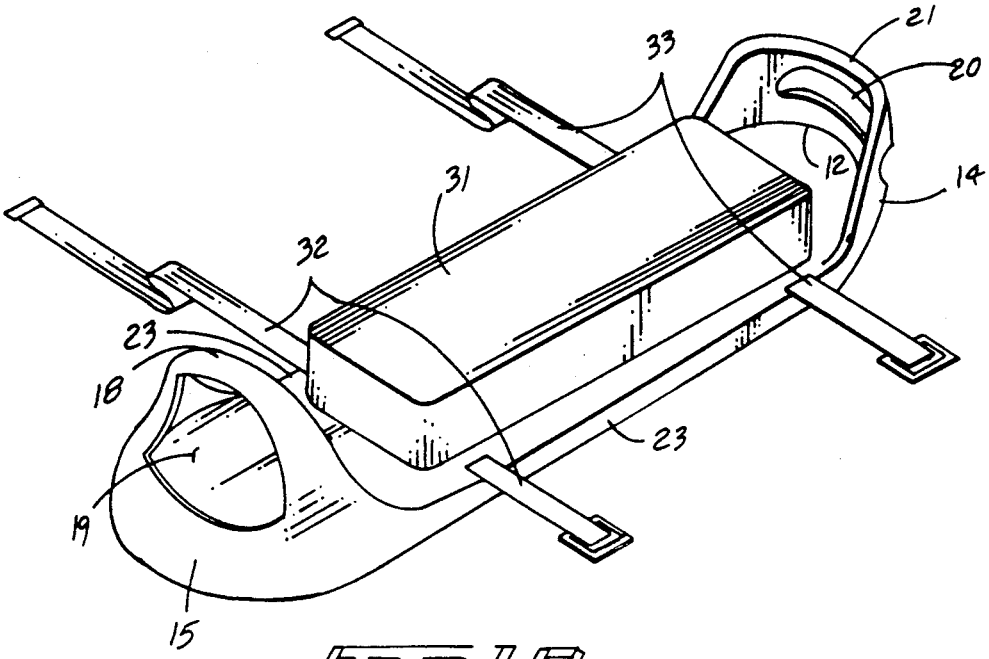
Fig 1A
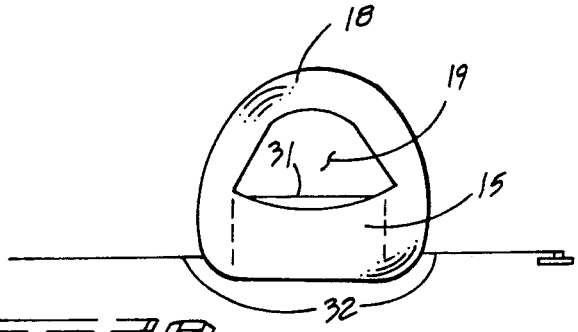
Fig 2A
Fig 3A
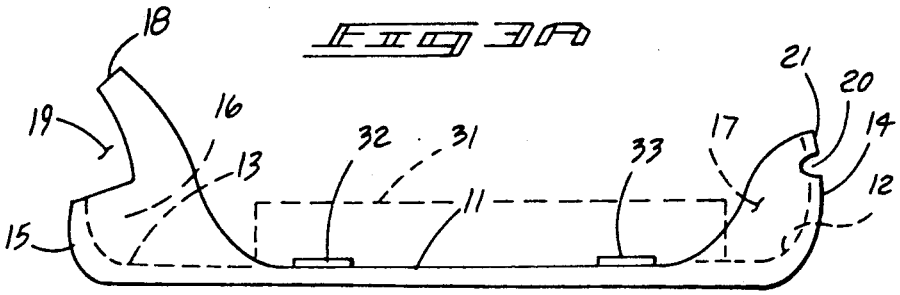

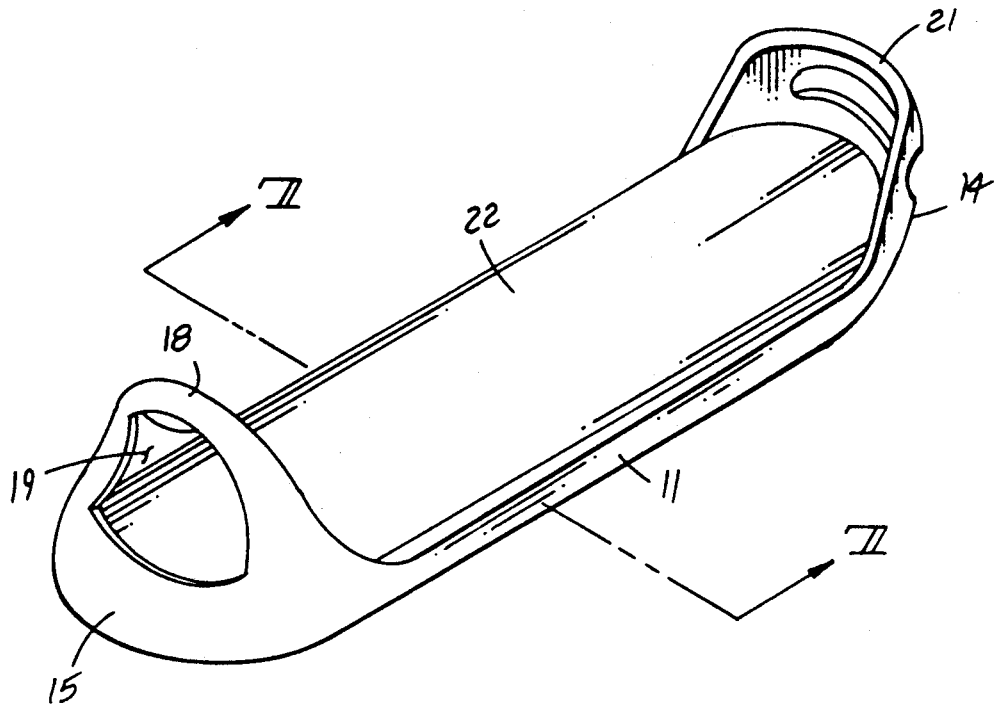
FIG 6
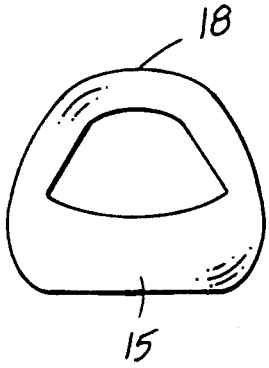
FIG 8
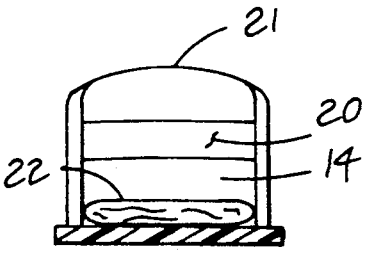
FIG 7
FIG 9
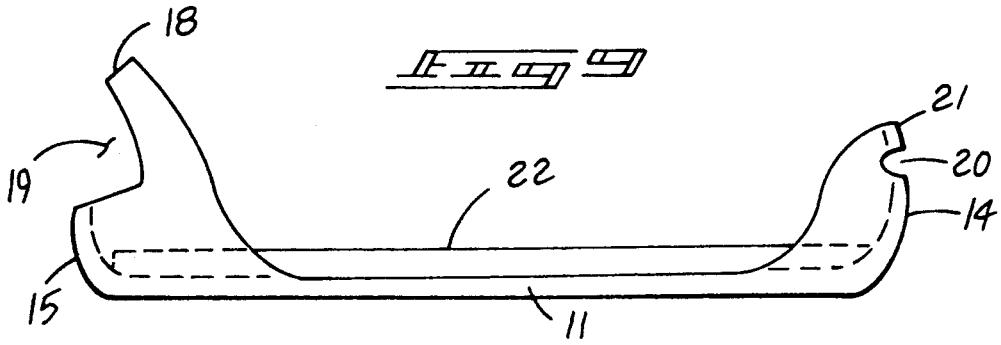

KNEE SUPPORT APPARATUS

BACKGROUND OF THE INVENTION

1. Field of the Invention

The field of invention relates to knee support apparatus, and more particularly pertains to a new and improved knee support apparatus wherein the same is arranged for supporting an individual in permitting the individual to permit support and mobility upon a freshly laid concrete surface.

2. Description of the Prior Art

When finishing a concrete slab and to permit troweling and the like, past practice has been to position workmen upon available boards or any available planar surfaces that permit support of the individual. Accordingly, it is understood that there is a long standing need to provide a support organization to permit an individual to maintain orientation upon a concrete or cementuous slab to permit disbursement of the weight to prevent unnecessary disfigurement of the slab during a finishing procedure. Prior art to this extent is exemplified in U.S. Pat. No. 4,346,784 to Hammond wherein a knee support structure includes rear and forward upwardly extending brackets to position an individual's leg therebetween.

U.S. Pat. No. 4,747,470 to Fernandez sets forth a plurality of tray members to receive an individual therewithin.

U.S. Pat. No. 4,043,424 to Crain sets forth an apparatus formed as a tray structure to permit an individual to kneel in a finishing procedure upon concrete.

U.S. Pat. No. 4,789,046 to McDowall sets forth a knee board for supporting an individual during a finish troweling procedure of cement and the like, wherein the knee board is formed of a deformable material.

As such, it may be appreciated that there continues to be a need for a new and improved knee support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of knee support apparatus now present in the prior art, the present invention provides a knee support apparatus wherein the same is arranged for accommodating an individual's foot and subsequently permitting a kneeling of the individual upon a cementuous slab. As such, the general purpose of the present invention, which will be described subsequently in greater detail, is to provide a new and improved knee support apparatus which has all the advantages of the prior art knee support apparatus and none of the disadvantages.

To attain this, the present invention provides a knee support apparatus for use as a flotation raft for utilizing a flotation raft with each foot for permitting ease of support of an individual upon a surface, such as concrete to be finished. Each raft includes a knee loop for support and for ease of transport, and a rearwardly oriented foot receiving socket. A modification of the invention includes padding for comfort enhancing positioning of the individual raft when used upon an uncured concrete surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved knee support apparatus which has all the advantages of the prior art knee support apparatus and none of the disadvantages.

It is another object of the present invention to provide a new and improved knee support apparatus which may be easily and efficiently manufactured and marketed.

It is a further object of the present invention to provide a new and improved knee support apparatus which is of a durable and reliable construction.

An even further object of the present invention is to provide a new and improved knee support apparatus which is susceptible of a low cost of manufacture with regard to both materials and labor, and which accordingly is then susceptible of low prices of sale to the consuming public, thereby making such knee support apparatus economically available to the buying public.

Still yet another object of the present invention is to provide a new and improved knee support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1*a* is an isometric illustration of the invention utilizing several cushions selectively mounted relative to the device.

FIG. 2*a* is an orthographic front view of the invention. as set forth in FIG. 1*a*.

FIG. 3*a* is an orthographic side view of the invention, as set forth in FIG. 1*a*.

FIG. 6 is an isometric illustration of the invention utilizing a cushion insert coextensive with the floor of the structure.

FIG. 7 is an orthographic view, taken along the lines 7—7 of FIG. 6 in the direction indicated by the arrows.

FIG. 8 is an orthographic end view of the invention.

FIG. 9 is an orthographic side view of the invention.

DESCRIPTION OF THE PREFERRED EMBODIMENT

Figure 1:
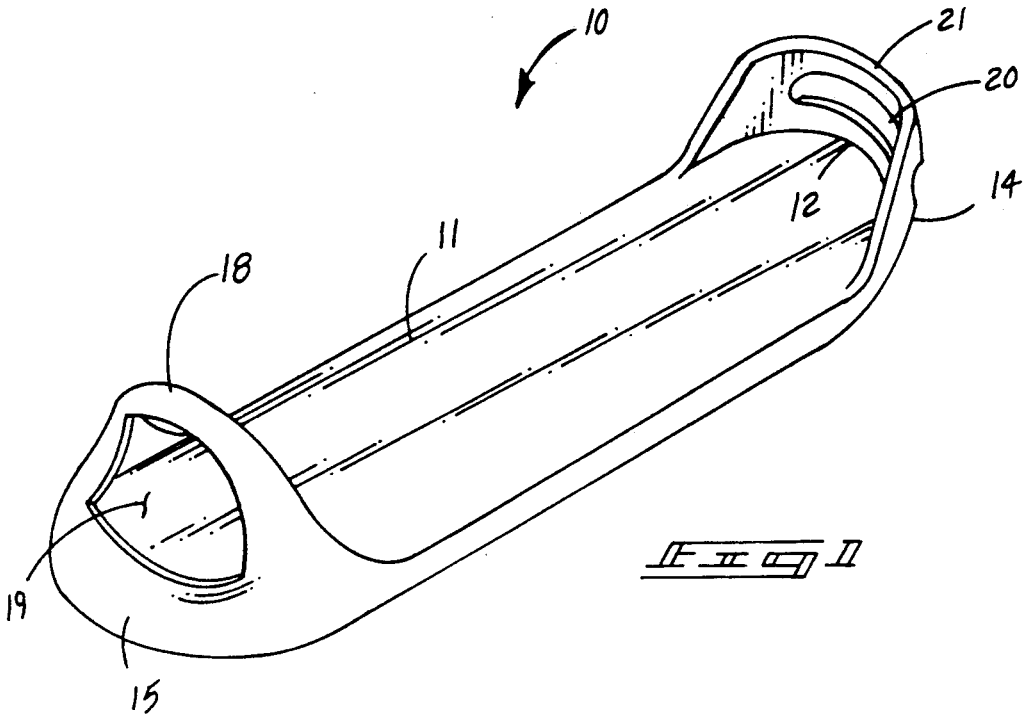
FIG. 1 is an isometric illustration of the instant invention.
Figure 2:
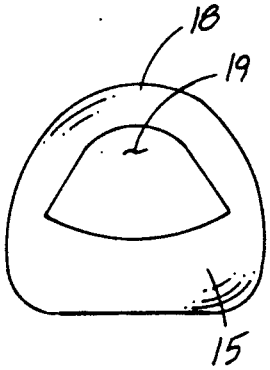
FIG. 2 is an orthographic front end view of the instant invention.
Figure 3:
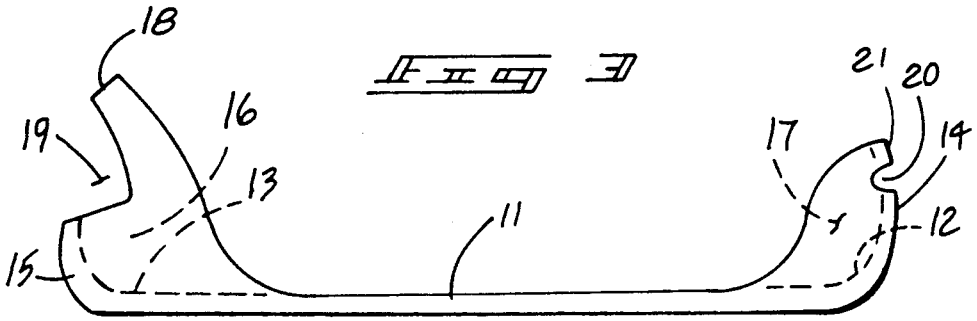
FIG. 3 is an orthographic side view of the instant invention.
Figure 4:
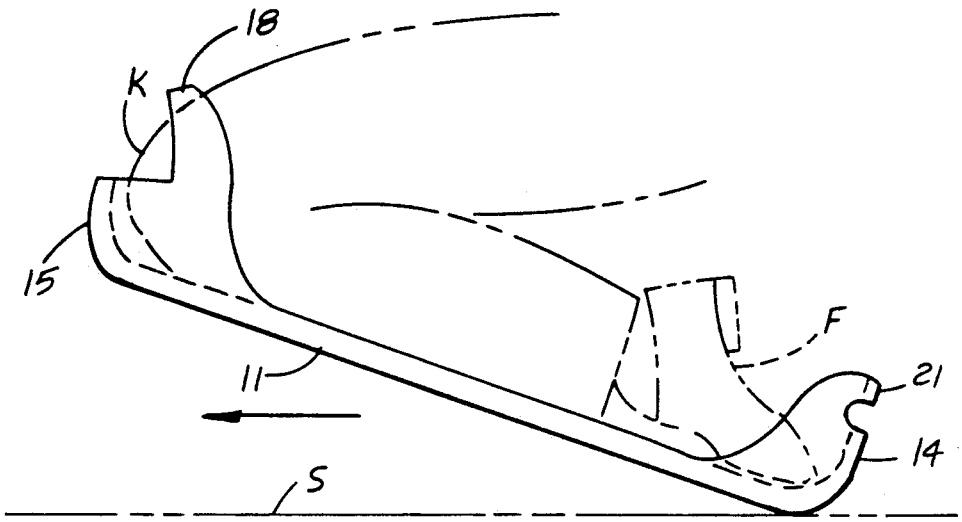
FIG. 4 is an orthographic side view of the invention in use in a forward locomotion upon a slab surface.
Figure 5:
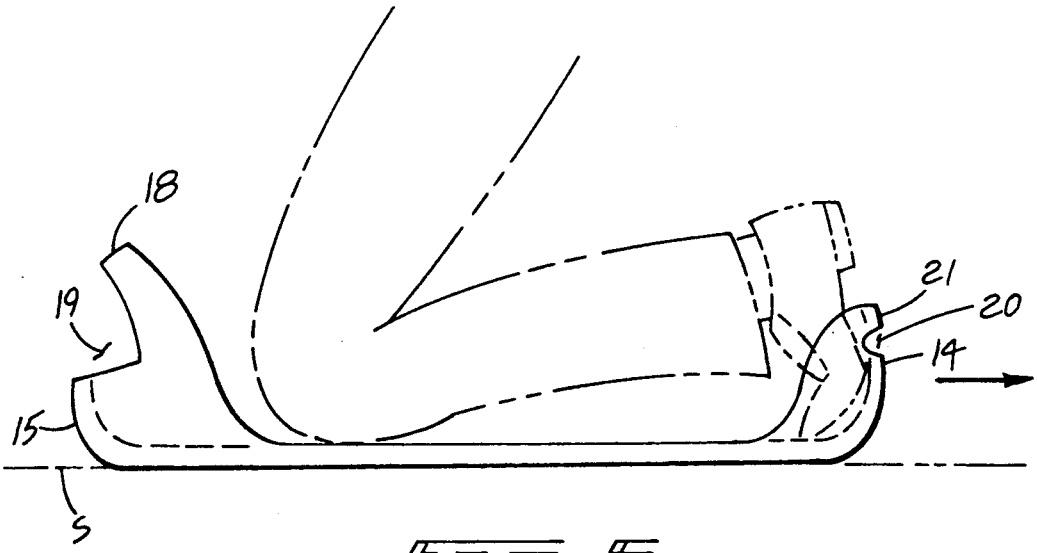
FIG. 5 is an orthographic side view of the invention for locomotion in a rearwardly oriented orientation upon a slab.

With reference now to the drawings, and in particular to FIGS. 1 to 9 thereof, a new and improved knee support apparatus embodying the principles and concepts of the present invention and generally designated by the reference numerals 10 will be described.

More specifically, the knee support apparatus 10 of the instant invention essentially comprises a raft to include a support plate 11 formed with a planar bottom surface. A top surface of the support plate 11 may be of a planar or of an anatomically complementary configuration, as desired. The support plate 11 terminates in an arcuate rear edge 12 and an arcuate forward edge 13. Extending upwardly of the support plate from the rear edge 12 is an arcuate rear wall 14 where extending upwardly from the forward edge 13 is an arcuate forward wall 15 defining a respective forward concave socket 16 and a rear concave socket 17 relative to the forward and rear walls respectively. The forward wall 15 includes a front loop 18 canted in a spaced relationship upwardly of the forward wall 15 defining a forward opening 19. A rear opening 20 is spaced between the rear wall 14 and an overlying rear loop 21. The rear and forward loops, while permitting use as handles for ease of manipulation and transport of the organization, further provide for a respective knee or foot engaging opening when the respective knee or foot, such as illustrated in the FIGS. 4 and 5 respectively, is directed into the respective forward and rear openings 19 and 20. The use of the openings 19 and 20 in lieu of merely solid walls provide for partial projection of the foot or the knee portion into the openings to enhance engagement of that portion of an individual's body when projecting the raft relative to a slab "S" in a finishing procedure.

The FIGS. 6–9 illustrate the use of a cushion pad 22 that extends substantially coextensively between the forward and rear edges 12 and 13 to provide enhanced comfort in use of the organization.

Further, the structure of the FIGS. 1*a*, 2*a*, and 3*a* illustrate the use of a cushion pad 31 that is retrofitted to the support plate 11, with the support plate 11 including respective first and second strap pairs 32 and 33 that extend laterally of side edges 23 of the support plate 11. In this manner, the cushion pad 31 to accommodate various cushions of various densities, thickness, and durometer ratings may be selectively utilized upon the support plate 11. Each strap pair includes a strap and buckle arrangement to provide securement of the cushion pad 31 relative to the support plate 11. It is also understood that various other fastening structure may be utilized to assemble the strap pairs together, such as hook and loop fastening members and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A knee support apparatus, comprising, an elongate rigid raft plate, the raft plate including a plate top surface coextensive with a plate bottom surface, wherein the plate bottom surface is of a planar configuration, and the raft plate including an arcuate rear edge and an arcuate forward edge, wherein the arcuate rear edge and the arcuate forward edge are formed of respective rear and forward edges of the support plate, and an arcuate rear wall extending upwardly from the arcuate rear edge, and an arcuate forward wall extending upwardly of the arcuate forward edge, and the arcuate rear wall defining a concave rear socket, and the arcuate forward wall defining a concave forward socket to receive a respective knee and foot portion within a respective forward and rear socket.

2. An apparatus as set forth in claim 1 wherein the forward wall includes a front loop extending upwardly of the front wall to define a forward opening to enhance engagement of the knee within the forward opening, and the rear wall includes a rear loop extending upwardly of the rear wall to enhance engagement of a foot portion within the rear opening.

3. An apparatus as set forth in claim 2 including a cushion pad mounted on the support plate between the rear wall and the forward wall.

4. An apparatus as set forth in claim 3 wherein the support plate includes respective side edges, and a respective first and second strap pair extending laterally of the side edges, wherein the first strap pair is arranged for securement about the cushion pad and the second strap pair is arranged for securement about the cushion pad to accommodate securement of the cushion pad to the support plate.

* * * * *